United States Patent [19]

Cuyl

[11] Patent Number: 5,076,014

[45] Date of Patent: Dec. 31, 1991

[54] WINDOW RAISING DEVICE FOR MOTOR VEHICLE

[76] Inventor: Christian Cuyl, 17, rue des Pres Heyds, F-90200, Giromagny, France

[21] Appl. No.: 345,707

[22] PCT Filed: Aug. 27, 1987

[86] PCT No.: PCT/FR87/00331

§ 371 Date: Mar. 3, 1989

§ 102(e) Date: Mar. 3, 1989

[87] PCT Pub. No.: WO88/01674

PCT Pub. Date: Mar. 10, 1988

[30] Foreign Application Priority Data

Sep. 3, 1986 [FR] France ..... 86 12457

[51] Int. Cl.[5] ..... E05F 15/00; E05F 11/48

[52] U.S. Cl. ..... 49/140; 49/349; 49/352

[58] Field of Search ..... 49/352, 140, 139, 349, 49/362

[56] References Cited

U.S. PATENT DOCUMENTS

| | | | |
|---|---|---|---|
| 3,791,071 | 2/1974 | Bosch | 49/349 X |
| 4,085,629 | 4/1978 | Fogarollo | 49/140 X |
| 4,168,595 | 9/1979 | Pickles et al. | 49/352 |
| 4,229,906 | 10/1980 | Pickles | 49/352 |
| 4,237,657 | 12/1980 | Kazewych | 49/352 |
| 4,335,541 | 6/1982 | Kazewych | 49/352 X |
| 4,672,771 | 6/1987 | Lam et al. | 49/352 |

FOREIGN PATENT DOCUMENTS

| | | | |
|---|---|---|---|
| 0023474 | 2/1981 | European Pat. Off. . | |
| 0039259 | 11/1981 | European Pat. Off. . | |
| 1114114 | 9/1961 | Fed. Rep. of Germany | 49/140 |
| 1285358 | 12/1968 | Fed. Rep. of Germany . | |
| 2836038 | 2/1980 | Fed. Rep. of Germany . | |
| 1285892 | 1/1962 | France . | |
| 2141390 | 1/1973 | France . | |
| 2318955 | 2/1977 | France . | |

*Primary Examiner*—Philip C. Kannan

*Attorney, Agent, or Firm*—Sandler, Greenblum & Bernstein

[57] ABSTRACT

Window raising device electrically and manually operated, of simple construction and providing for a firm retention of the window in order to obtain a burglarproof window. A carriage fixed to the window and sliding in a guide is secured to both ends of a flat belt which slides on two return pads made of synthetic material. The belt is perforated or toothed in its portion passing on a toothed drum. The drum is slidingly mounted on a gear of a main sliding shaft which traverses an electrical driving mechanism. The sliding of the main shaft disengages the shaft from the motor drive but does not disengage its gear from the drum in order to provide a manual drive. The device is useable in a door or in a fixed part of a motor vehicle.

11 Claims, 4 Drawing Sheets

WINDOW RAISING DEVICE FOR MOTOR VEHICLE

BACKGROUND OF THE INVENTION

1. Field of the Invention

The present invention relates to a window-raising device for a motor vehicle, comprising rotary drive means, a transmission belt which follows a closed path passing onto a drum connected to the drive means and onto upper and lower return pads having curved convex tracks onto which the belt passes by sliding, a carriage affixed to the window and to the flexible transmission element between the upper and lower return pads, and guidance means connected to this carriage, the belt being provided with engagement means which cooperate with corresponding engagement means provided on the drum.

2. Discussion of the Background and Relevant Information

With respect to conventional devices having a cable and pulleys, the window-raising devices of this type have the advantage of a lesser weight, good resistance to water and especially an excellent durability even in the absence of maintenance work, while having a competitive price by virtue of the use of a majority of parts made of synthetic molded material EP-A-0 023 474 describes such a device, in which the motor mechanism comprises a planet gear adapted to either allow alternatively a motorized drive or a manual drive by handle. In effect, one knows that in this case any breakdown hindering the operation of the motor has the effect of hindering all movement of the window, even by a manual drive of the main shaft of the mechanism, because the latter is blocked by the reducer connected to the motor. The solution adopted in the known device consists of connecting the reducer to the main shaft by means of a planet gear whose satellite plate is connected to a reserve manual drive. However, this solution is disadvantageous because such a mechanism is relatively costly, cumbersome and heavy. In addition, one must block the rotation of the satellite plate to allow the motorized drive and likewise prevent the mechanism from being able to turn under the effect of a diminishing pressure applied to the window by a burglar trying to force the door.

SUMMARY OF THE INVENTION

The object of present invention is to perfect the known device as discussed above, so as to achieve a construction which is simpler, more lightweight and inexpensive, and to ensure a better protection against attempted forced entries.

To this end, the device according to the invention is characterized in that the drive means comprise a drive gear which is affixed to a main shaft and which is placed in an axial boring having cogs within the drum, with the cogs of the gear being engaged around its entire circumference with the interior cogs of the drum. The main shaft is connected to a manual activation means and to a motorized activation means comprising an outer gear provided with an axial boring in which the main shaft is coaxially positioned. The boring comprises at least one crown gear projecting within, and the main shaft comprises at least one outwarding projecting corresponding crown gear, arranged to be engaged in the outer gear. The axial length of the crown gears being less than the length of the drive gear, so that the main shaft is slidable, to pass from a motorized drive position in which the respective crown gears are engaged in one another, to a manual drive position in which said crown gears are disengaged from one another without the drive gear being entirely disengaged from the cogs of the drum.

The axial boring of said wheel can include two crown gears separated by a distance greater than their respective widths, and the main shaft may comprise two corresponding crown gears separated by the same distance as the crown gears of the outer gear.

In a preferred embodiment of the device, each return pad comprises a central orifice positioned on the interior side of the curvature of the track and the pad is carried by a fixed pin engaged in the central orifice in a manner so that the pad can pivot around the pin in a limited angle. At least one longitudinal portion of the track is eccentric with respect to the central orifice, with the end of the track directed from the side of the drum being more removed from this orifice than the end directed from the side of the carriage. The central orifice and the corresponding portion of the fixed pin can be partially spherical, so that the pad can sustain a transverse inclination limited with respect to the pin if the belt is not rectilinear between the two return pads.

Preferably, the carriage comprises a part made of synthetic material having at least one transverse protuberance adapted to be engaged in an opening provided in the window, at least one longitudinal protuberance adapted to slide along a guide, and perforated lugs for the fixation of the carriage to the ends of the belt, said transverse protuberance comprising a head arranged to cooperate with a locking hook which retains this protuberance in the opening of the window.

BRIEF DESCRIPTION OF THE DRAWINGS

The invention and its advantages will become more clear from the description of a preferred embodiment, given below by of example and in reference to the annexed drawings, in which.

DESCRIPTION OF THE PREFERRED EMBODIMENTS

Figure 1:
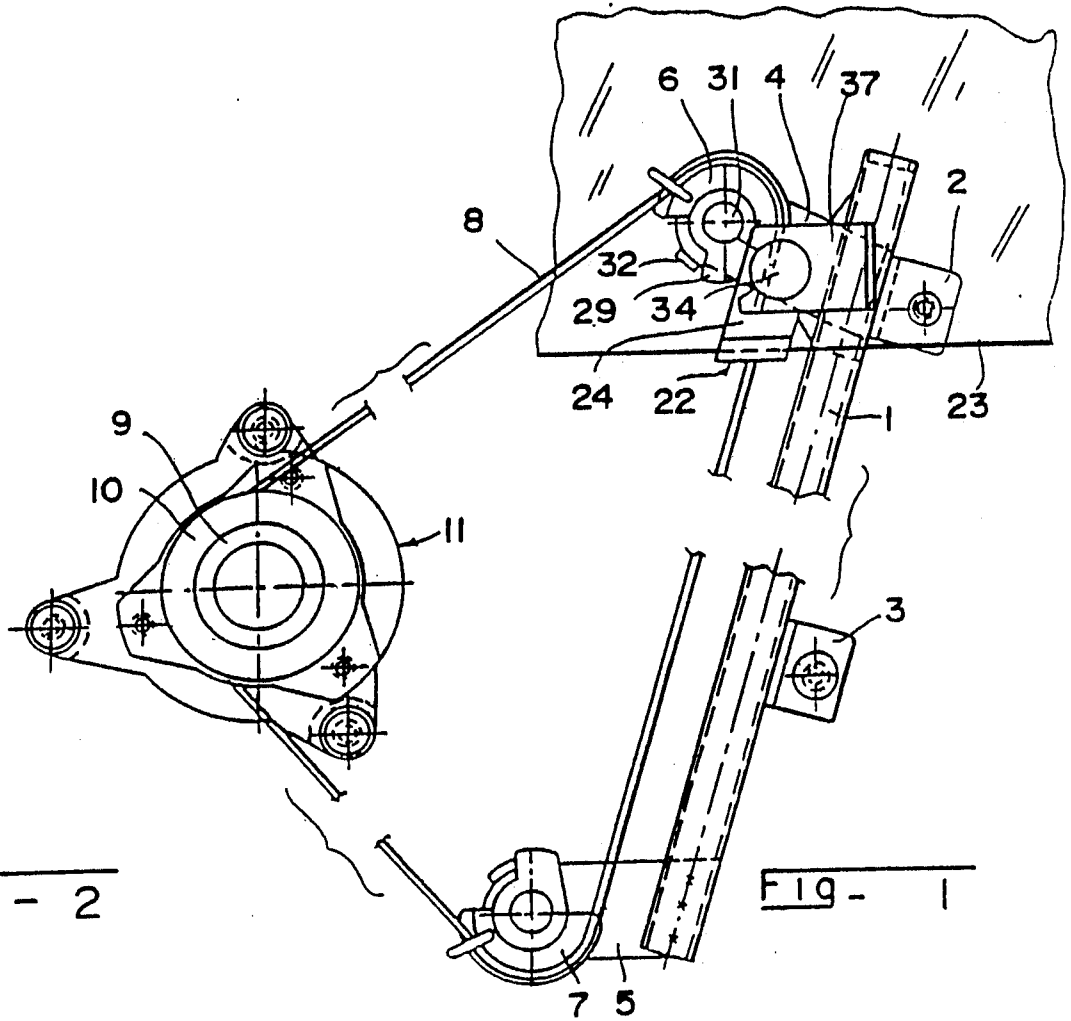
FIG. 1 is a schematic view in lateral elevation of a form of the window-raising device having a belt according to the present invention.

In reference to FIGS. 1-4, the window-raising device for a motor vehicle comprises a guide-support assembly comprising a guide 1, constituted by a section member which is composed of metallic or synthetic material positioned in the direction of the movement of the window, the lugs 2 and 3 for the fixation of this guide in the vehicle, for example in a door, and two supports 4 and 5 to support respectively an upper pad 6 and a lower pad 7 serving as elements of return of the transmission member constituted by a flat belt 8, provided to slide on these two pads. The belt 8 passes onto a drive drum 9, placed in a housing 10 and attached to a drive mechanism 11.

Figure 3A:
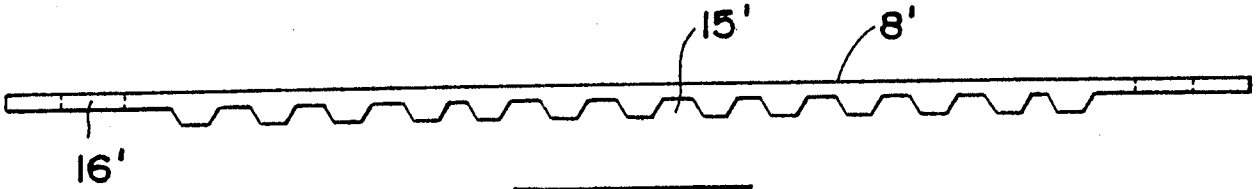
FIG. 3A is a front end elevational view of a notched belt according to another embodiment of the invention.
Figure 4B:
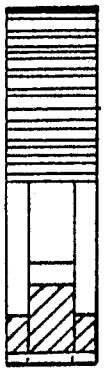
FIGS. 4A and 4B are a front end elevational view and a side view in partial cross-section of the drum, respectively.
Figure 4A:
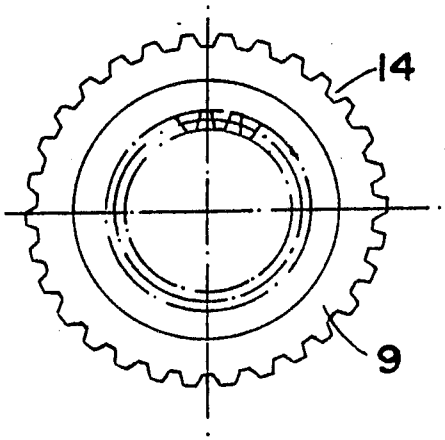
Figures 3, 4, 5, 6, 7, 8, 9, 10, 11, 12, 13:
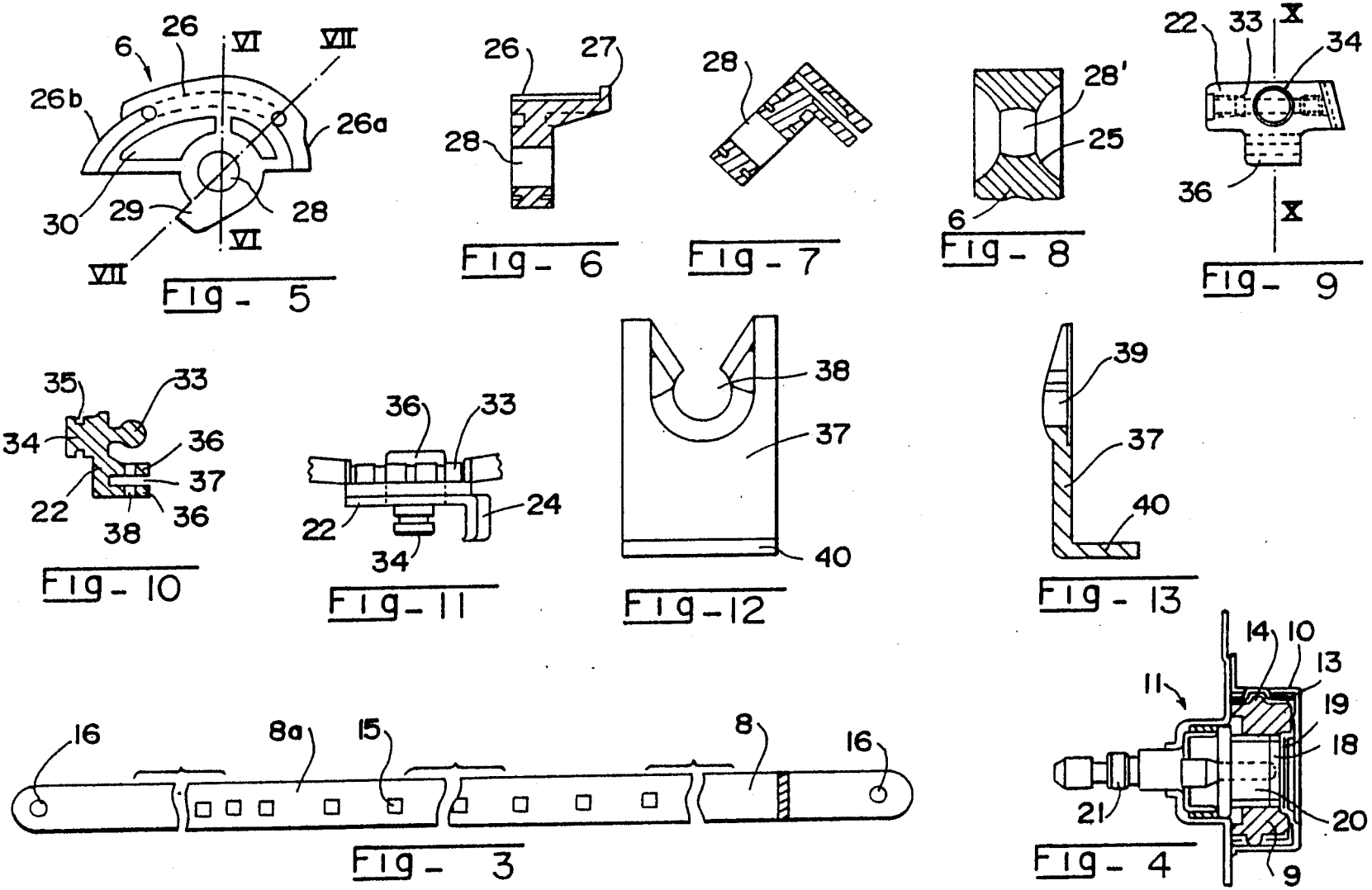
FIG. 3 is a partial view of the belt.
FIG. 4 is a partial cross-sectional view of a form of the drive mechanism.
FIG. 5 is a lateral view of a return pad of the belt.
FIGS. 6 and 7 are transverse cross-sectional views of the return pad, respectively following lines VI—VI and VII—VII of FIG. 5.
FIG. 8 is a cross-sectional view of a part of the pad, in a particular embodiment.
FIGS. 9, 10 and 11 represent a carriage forming part of the device, respectively in lateral, view, in transverse cross-section along X—X in FIG. 9, and in front view.
FIGS. 12 and 13 represent, in enlarged scale and respectively in lateral view and in transverse cross-section, a hook to affix the window onto the carriage illustrated by FIGS. 9–11.

The drum 9 and mechanism 11 are illustrated in more detail in FIG. 4. Drum 9 is a part made of synthetic material, having a cylindrical peripheral surface 13 along which the belt 8 is applied by approximately a quarter turn. This surface 13 is provided with a series of cogs 14 which are evenly spaced, which are engaged in perforations 15 distributed along the central portion of belt 8, to realize an engagement between the belt and the drum. The housing 10 is adjacent to the apex of the cogs 14 and it comprises two slots (not shown) permitting the entrance and exit of the belt. Thus, a sliding of the belt 8 on the drum 9 is impossible. FIG. 3 shows that the belt 8 is perforated only in its central portion 8*a*, with the exception of two orifices 16 provided respectively in its ends, with a view to attachment of the latter as one will described later. Similarly, FIG. 3A illustrates the belt 8' according to another embodiment of the invention wherein the belt is notched at 15' and includes orifices 16' at each end.

Drum 9 has an axial boring 18 in which penetrates a reinforcement 19 of housing 10, to maintain the position of the drum. The peripheral surface of the boring 18 comprises interior cogs which are engaged in all its circumference with the exterior cogs of a gear 20 affixed to a main shaft 21 of the drive mechanism 11. An embodiment of this mechanism will be described later. It is to be noted that the assembly described above of the drum 9 on the gear 20 is preferable in that it permits moderate stresses between the gear and the drum, at the same time as an axial play which is preferable for the assembly and which permits an advantageous switching between a motorized drive and a manual drive.

Figure 2:
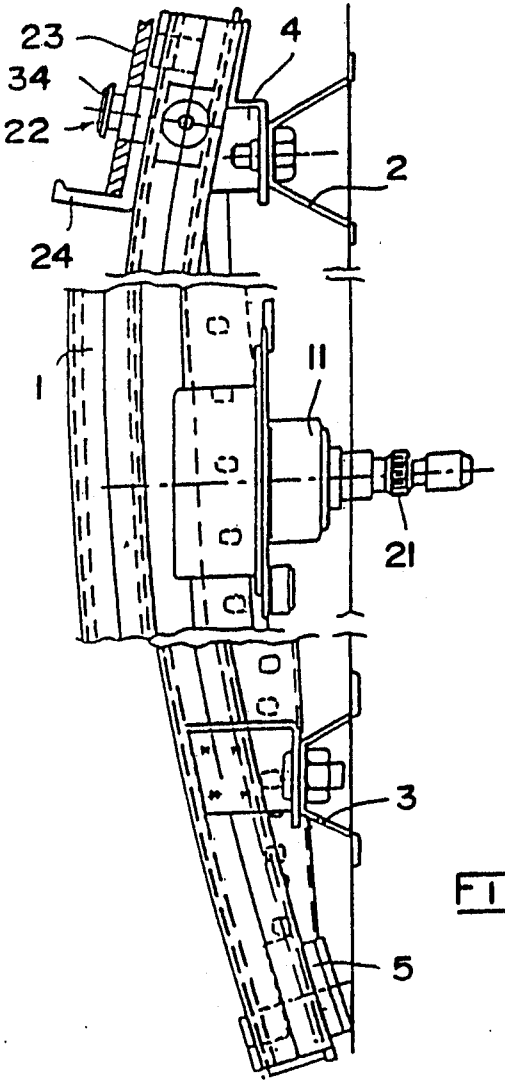
FIG. 2 is a front schematic view of this device.

FIGS. 1 and 2 also illustrate a carriage 22 which is affixed to the two ends of the belt 8 and which is arranged to slide along guide 1. The carriage 22 supports a window 23 by means of a curved lug 24 and it is affixed to the window in a manner which will be described later. Furthermore, FIG. 2 illustrates that the section member constituting the guide 1 is curved longitudinally. In fact, its curvature corresponds to the curvature of the window 23, which is assumed as being curved in this particular case. Nevertheless, the device described above can be applied as well to a flat window and comprise a rectilinear guide.

FIGS. 5-7 show a particular embodiment of the upper pad 6 constituted of a single piece of molded synthetic material, for example polyamide. This pad comprises on its peripheral surface a convex curved track 26, on which the belt 8 slides, and a longitudinal shoulder 27 serving to guide the edge of the belt. Within the curve outlined by the track 26, the pad is provided with an central orifice 28 whose axis is substantially parallel to the surface of the track 26. On the other hand, the central portion of the pad comprises a projection 29, whereas its intermediate portion is lightened by openings 30. The orifice 28 of the pad is nested on a pin 31 (FIG. 1) of the support 4, so that the pad can pivot back and forth around this pin, along an angle which is limited by abutment of the projection 29 against the stops 32 affixed to the support 4. This movement occurs under the effect of friction of the belt 8 at the beginning of a starting of the device to raise or lower the window, which reduces the starting effort exerted by the drive mechanism 11.

FIG. 8 shows an advantageous alternative for the mounting of pads 6 or 7 on their respective supports. In this case, pad 6 comprises a central orifice 28' which has the shape of a spherical segment, the support pin also having a corresponding spherical shape (not shown) to constitute a sort of swivel joint permitting a transverse inclination of pad 6, and lateral shoulders limiting this inclination by abutment against the lateral surfaces 25 of the pad. This swivel joint mounting is preferable in combination with a guide which is curved, because it permits the pad to continually make, the optimal orientation controlled by the belt 8, and more particularly by the section of this belt between the pad and the carriage 22, which avoids a transverse flexion of the belt when the carriage occupies a laterally transported position with respect to a straight line connecting the two pads.

Furthermore, FIG. 5 shows that the sliding track 26 of the pad comprises a longitudinal portion 26*a* having a shape of the arc of a circle centered on the orifice 28, whereas the other portion 26*b* of the track is eccentric, by being further removed from the center of the orifice 28 than the portion 26*a*. This longitudinal eccentric shape has the effect of maintaining the belt 8 very taut when the window descends, i.e. when the friction of the belt on the pad 6 tends to make the latter turn clockwise in the case of FIGS. 1 and 5. This effect manifests itself particularly if one tries to press heavily on the window 23 to lower it without activating the mechanism 11, for example during an attempted burglary. The upper branch of the belt 8, which is retained by engagement on the drum 9, can then be subjected to great tension and thus stretch somewhat, which leads to a slight rotation of the upper eccentric pad 6, which increases the tension of the belt and the friction stresses between the belt and the pad, contributing to prevent the lowering of the window and relieving mechanism 11. This additional security is procured by the device by virtue of a simple adaptation of the shape of the pad 6, and does not necessitate the addition of a spring tending to make the pad turn.

A preferred embodiment of the carriage 22 is shown in detail in FIGS. 9 to 11. It involves a molded monoblock element of rigid synthetic material, having on one side a longitudinal protuberance 33 arranged to slide in guide 1, on the opposite side a cylindrical projection 34 provided with a ring-shaped groove 35, and on a third side a pair of parallel lugs 36 separated by a slot 37 and provided with one or more orifices 38, for the fixation of the two ends of the belt 8 between the lugs 36. Simple linch pins mounted in the orifices 38 and 16 make it possible to affix the belt to the carriage without any possible sliding.

The projection 34 is designed to be nested in an opening or a notch provided in the window 23, whereas the lower edge of this window rests on the curved lug 24 of the lower end of the carriage 22, as shown in FIGS. 1–2. This carriage is then locked against the window by means of an elastic hook affixed in the groove 35 of projection 34. FIGS. 12 and 13 show an example of such a hook 37 made of rigid synthetic material. The latter has an opening 38 adapted to receive projection 34 and surrounded by a curved edge 39 ensuring an elastic tightening of the window. The other end of the hook 37 is a curved lug 40 which can be blocked against the lug 24 of the carriage.

In the device described above, most of the essential parts can be made of molded synthetic material, and are therefore lightweight, inexpensive in mass production, and necessitating little or no upkeep by virtue of their resistance to humidity and to other chemical agents. Moreover, its operation is similar in principle to that of a conventional device having cables and pulleys, but is more reliable with respect to risks of wear and tear and jamming, as well as attempted forced openings by weight on the window.

Figure 14:
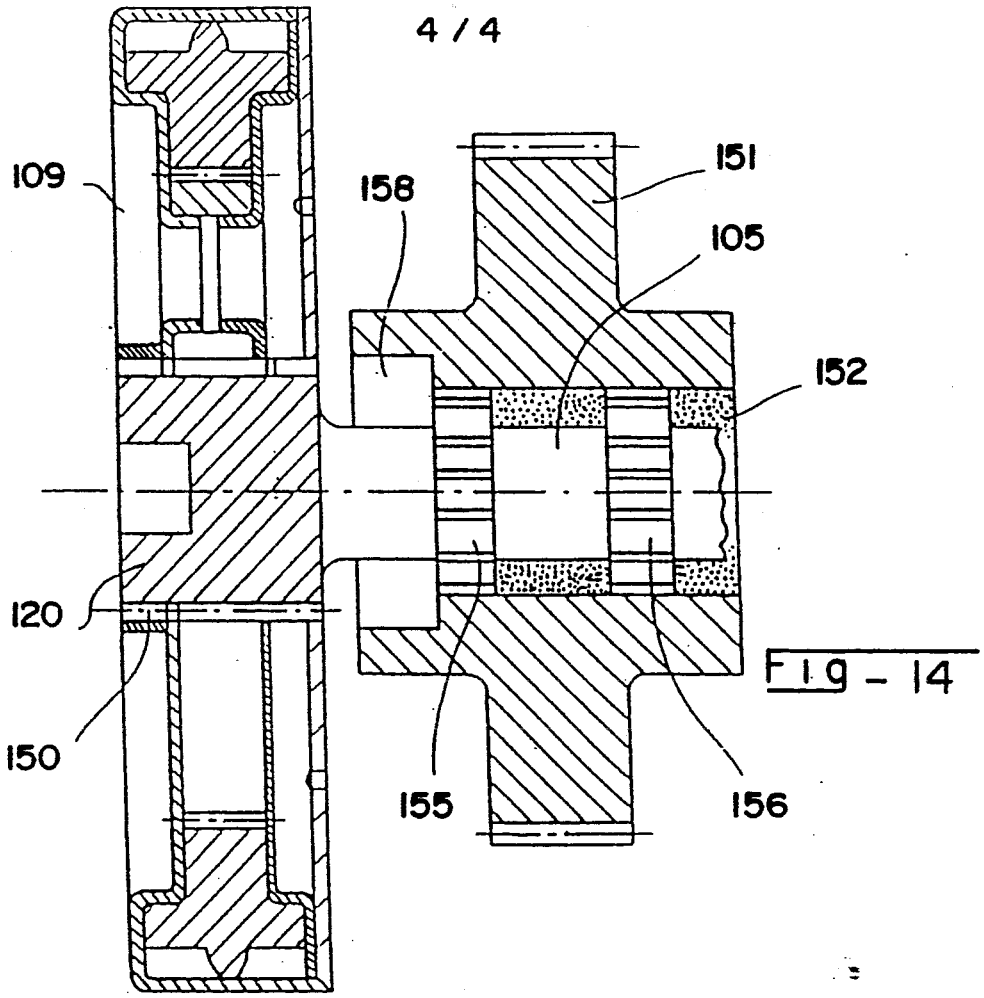
FIG. 14 is a partial transverse cross-sectional view of a preferred embodiment of the drive mechanism of the device according to the invention, in a motorized drive position.
Figure 15:
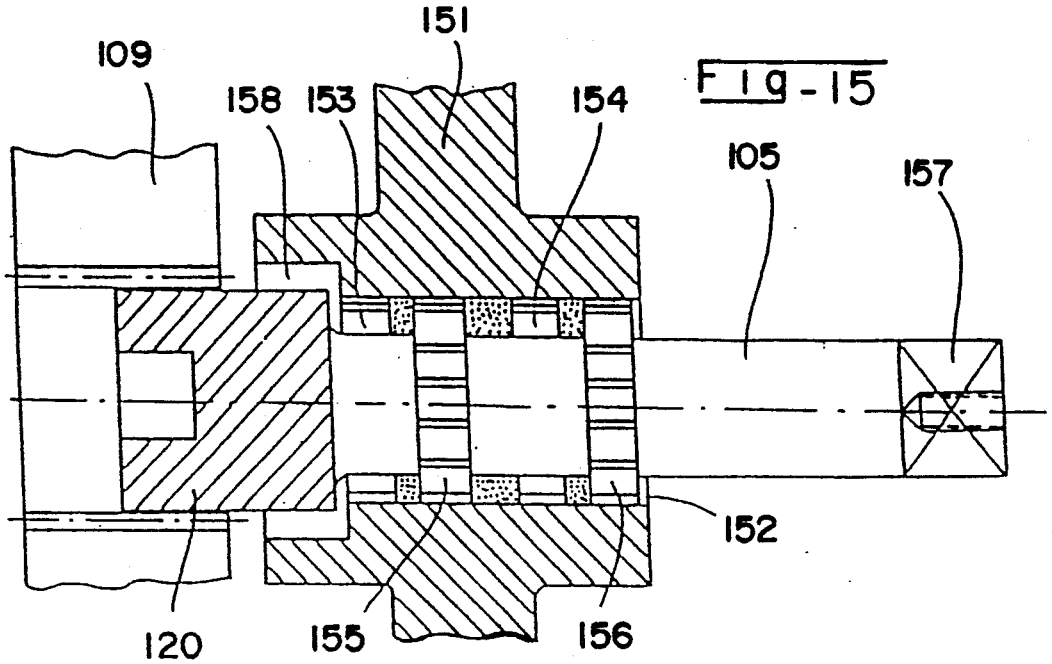
FIG. 15 is a view analogous to FIG. 14, showing the same in a manual drive position.

In FIGS. 14 and 15 is illustrated a particular embodiment of the drive mechanism of the window-raising device according to the present invention, in the case where an electric motor drive is provided. One knows that in this case, any breakdown preventing the operation of the motor has the effect of preventing any movement of the window, with a manual drive of the main shaft of the mechanism, because the latter is blocked by the reducer connected to the motor. In the known device, the reducer is connected to the main shaft by means of a planet gear whose satellite plate is attached to a reserve manual drive. However, this solution is disadvantageous because such a mechanism is relatively expensive, cumbersome and heavy. In return, by virtue of the mounting of the drive drum on a cogged gear of the main shaft, as described above, the present invention makes it possible to resolve this problem without adding additional parts to the mechanism, simply by virtue of a particular inexpensive structure of the elements regularly used.

In FIGS. 14 and 15, the elements which are similar to those of the mechanism 11 described above, bear similar reference numbers, but increased by 100. The end gear 120 of the main shaft 105 carries a cogged drum 109 whose embodiment is somewhat different from that of drum 9 but whose operation is similar. In particular, the drum 109 comprises interior cogs which are engaged in 150, around its entire circumference, in the right cogs of gear 120 and can slide axially on the latter. The main shaft 105 of the mechanism coaxially traverses an outer gear 151 of a reducer connected to an electric motor. The central boring 152 of the gear 151 has two projecting crown gears 153 and 154 positioned parallel and spaced by a distance which is greater than the width of each crown. For its part, the main shaft 105 comprises on its exterior surface two corresponding crown gears 155 and 156 arranged to be engaged simultaneously in the crown gears 153 and 154 in the position illustrated in FIG. 14. The crown gears 155 and 156 have the same axial spacing as the crown gears 153 and 154. Thus, the gear 151 is affixed in rotation with the shaft 105 and permits a motorized drive of the window-raising device.

To make it possible to manually activate the window-raising device by the drum 109, a retractable handle (not shown) is affixed to the end 157 of the shaft 105. In addition, the shaft 105 can slide in the drum 109 and in the boring 152 of the gear 151 to take the manual drive position illustrated by FIG. 15. The cogs of the crown gears 155 and 156 of the shaft are then disengaged from crown gears 153 and 154 of the outer gear 151 and their heads can slide against the cylindrical surfaces of boring 152, by virtue of the fact that the axial distance between the crown gears is greater than the width of the crown gears. In return the gear 120 has a sufficient length so that its cogs remain engaged in the cogs of the drum 109. A frontal opening 158 is provided in gear 151 to allow the gear 120 to pass and serve as abutment. In this position, one can make the axle 105 and drum 109 turn to activate the window-raising device, even if the gear 151 is blocked.

Of course, the two crowns 153 and 155 would be sufficient for the drive, but the presence of two pairs of crown gears is advantageous for assuring that the axle 105 and the gear 151 are maintained in the respective coaxial positions, which makes it possible to position the bearings (not shown) on a sole element. In another alternative, the crown gear 154 could be eliminated and the crown gear 156 could be smooth. It must be noted likewise that the gear 151 can preferably be made of synthetic material.

According to an alternative, the perforations 15 of the belt can be replaced by other means of engagement, for . example lateral notches or lateral cogs, cooperating with the corresponding cogs provided on drum 9. In place of the belt 8, one can also use a belt notched on a surface, with a drum that is also notched. The belt can also be continuous and the carriage can have an element such as cogs or a notched housing to be affixed to the belt without the risk of sliding.

The device described above by way of example can again be the object of numerous other modifications or obvious alternatives for one with ordinary skill in the art, without going beyond the scope of the invention. In particular, one can use different materials to make the belt 8, especially a flexible synthetic material reinforced by fiberglass or metallic fibers. The fact that the belt is perforated only in its portion which cooperates with the drum is advantageous from the point of view of resistance, rigidity and longevity of the belt.

The device according to the invention is usable in a door as well as in a fixed element of a vehicle.

I claim:

1. Window-raising device for a motor vehicle permitting manual and motorized movement of a window comprising:

a drum connected to rotary drive means for rotating said drum;

upper and lower return pads having convex curved tracks;

a transmission belt following a closed path passing upon said drum and in sliding contact with said upper and lower return pads, said transmission belt including means for engagement which cooperate with corresponding means for engagement on said drum;

a carriage affixed to said transmission belt between said upper and lower return pads and capable of being affixed to the window, and means for guiding being connected to said carriage;

said rotary drive means comprising a drive gear having gear cogs which is affixed to a main shaft and which is lodged in an axial boring having interior cogs within said drum, said gear cogs being engaged with said interior cogs of said drum, said main shaft is associated with means for permitting either manual or motorized activation comprising an outer gear having an axial boring in which said main shaft is coaxially positioned, said axial boring including at least one crown gear and said main shaft including at least one corresponding crown gear arranged to be engageable in said at least one crown gear of said outer gear, said at least one crown gear having an axial length which is less than the length of said drive gear, and said main shaft being slidable between a motorized drive position in which said at least one crown gear and said at least one corresponding crown gear are engaged with one another, and a manual drive position in which said at least one crown gear and said at least one corresponding crown gear are disengaged from one another while said gear cogs of said drive gear remains engaged with said interior cogs of said drum.

2. The device according to claim 1, wherein said at least one crown gear comprises two crown gears separated by a distance greater than their respective widths, and said at least one corresponding crown gear comprises two corresponding crown gears separated by the same distance as the crown gears of the wheel.

3. The device according to claim 1, wherein each of said upper and lower return pads comprises a curved track, a central opening, a fixed pin engageable in said central opening so that the pad can pivot around this pin in a limited angle, and at least one longitudinal portion of said curved track is eccentric with respect to said central opening so that an end of said curved track directed towards said drum is further from said central opening than an end of said curved track directed towards said carriage.

4. The device according to claim 3, wherein said central opening and a corresponding portion of said fixed pin are partially spherical, so that the pad can sustain a limited transverse inclination with respect to said fixed pin.

5. The device according to claim 1, wherein said carriage comprises at least one transverse protuberance adapted to be engaged in an opening provided in the window, at least one longitudinal protuberance adapted to slide along said means for guiding, and perforated lugs for fixation of said carriage to ends of said transmission belt.

6. The device according to claim 5, wherein said carriage is composed of synthetic material.

7. The device according to claim 5, further including a locking hook, and wherein said transverse protuberance includes a head arranged to cooperate with said locking hook which retains said transverse protuberance in an opening of the window.

8. The device according to claim 1, wherein said means for engagement and said corresponding means for engagement on said drum comprise perforations or notches in said transmission belt and corresponding cogs on said drum.

9. The device according to claim 8, wherein said transmission belt includes perforations or notches at a portion passing onto said drum and at two ends which are affixed to said carriage.

10. The device according to claim 9, wherein said transmission belt only includes perforations or notches at said portion passing onto said drum and at said two ends which are affixed to said carriage.

11. The device according to claim 1, characterized in that said belt is a notched belt.

* * * * *